United States Patent [19]

Petermann et al.

[11] 3,985,572

[45] Oct. 12, 1976

[54] AUTOMATIC SPRAY CLEANING APPARATUS AND METHOD

[75] Inventors: James P. Petermann, Tigard; Frederick D. Helversen, Portland; Jack A. Thomas, Tigard, all of Oreg.

[73] Assignee: Georgia-Pacific Corporation, Portland, Oreg.

[22] Filed: Nov. 4, 1974

[21] Appl. No.: 520,771

[52] U.S. Cl. ..... 134/34; 134/22 R; 239/1; 239/227; 134/167 R

[51] Int. Cl.[2] ..... B08B 3/02

[58] Field of Search ..... 239/1, 225, 227, 186, 239/287, 11; 134/22 R, 24, 57 R, 167 R, 168 R, 34

[56] References Cited

UNITED STATES PATENTS

| | | | |
|---|---|---|---|
| 2,858,836 | 11/1958 | Geh et al. | 239/225 X |
| 3,276,695 | 10/1966 | Giardino et al. | 239/186 X |
| 3,444,869 | 5/1969 | Guignon et al. | 134/167 R |
| 3,726,481 | 4/1973 | Foster et al. | 239/287 |
| 3,797,745 | 3/1974 | Haus | 239/227 |
| 3,802,447 | 4/1974 | Bender | 134/57 R |
| 3,830,430 | 8/1974 | Hartunian | 239/227 X |
| 3,836,434 | 9/1974 | Novy | 134/168 R X |

*Primary Examiner*—Evon C. Blunk
*Assistant Examiner*—Michael Mar
*Attorney, Agent, or Firm*—Klarquist, Sparkman, Campbell, Leigh, Hall & Whinston

[57] ABSTRACT

An automatic high pressure spray cleaning apparatus and method for rapidly and efficiently removing material coated on the surface of an object are described. In accordance with the invention the axis of the cleaning liquid spray forms an acute angle with the object surface and such angle, as well as the distance along such axis between the spray nozzle and the object surface, are both maintained substantially constant over a given surface area. In addition, the pressure of the cleaning liquid at the surface of the object is also maintained substantially constant over such given area. The spray nozzles are automatically moved rotationally about a cleaning axis and longitudinally along such axis to scan over the object surface along a predetermined path while maintaining the spacing distance and angle substantially constant during rotation of the nozzles about the cleaning axis at a given longitudinal position on such axis, by motor operated drive means which may be controlled by an electronic computer. The cleaning apparatus is especially useful for cleaning the interior surface of container tanks, such as chemical reactor tanks which contain internal baffles and other obstructions. The nozzles are mounted on folding support arms which are supported on a vertical shaft to fold such arms in and out relative to the axis of such shaft. In addition, the support shaft rotates the nozzles through a predetermined horizontal arc and also raises and lowers the cleaning apparatus. The cleaning apparatus is supported on a mobile derrick for movement of such apparatus along guide rails between a plurality of container tanks. The reactive forces produced by the liquid spray on the spray nozzles are balanced so that the total bending force exerted on the vertical shaft is kept at a minimum regardless of the position of the folding support arms carrying such nozzles.

34 Claims, 15 Drawing Figures

FIG. 3
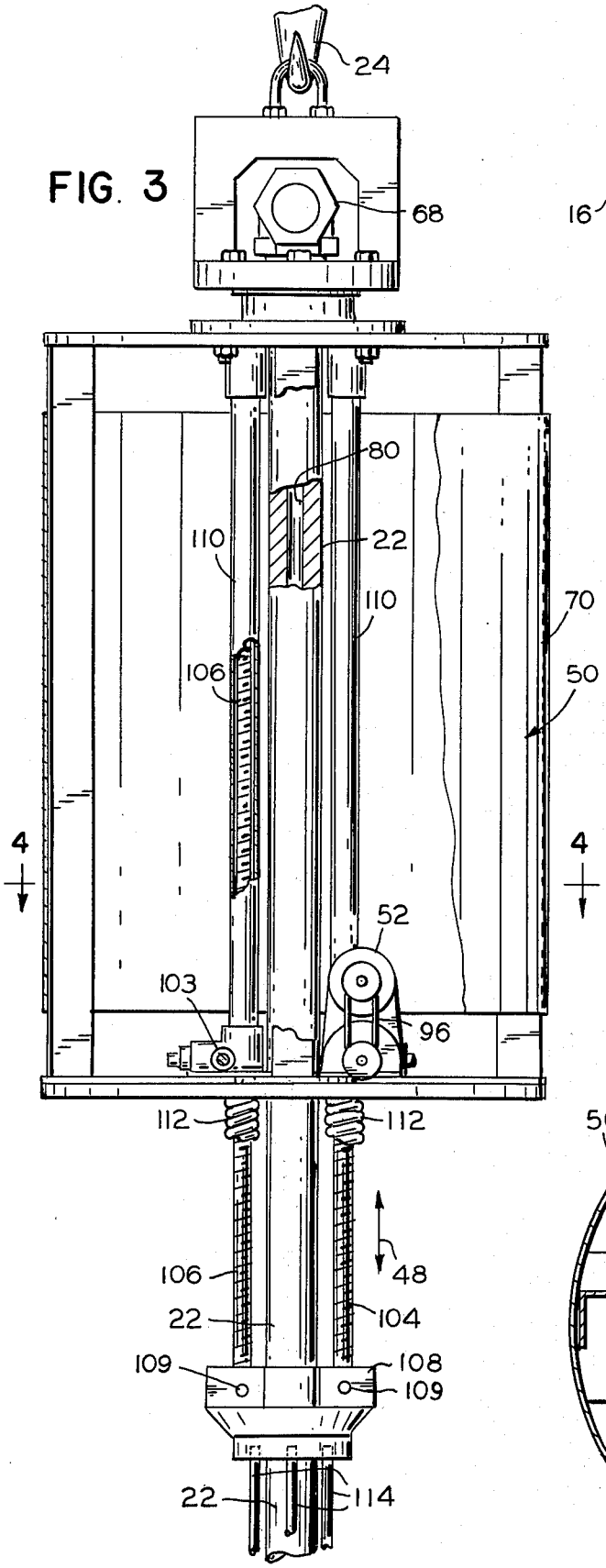
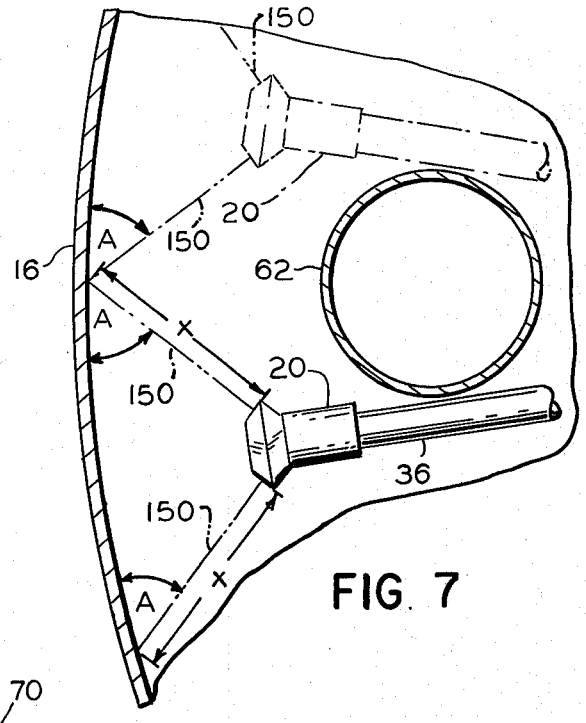
FIG. 7
FIG. 4
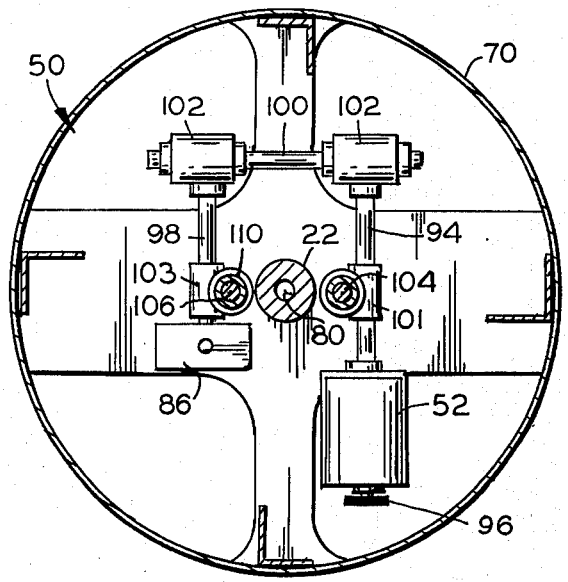

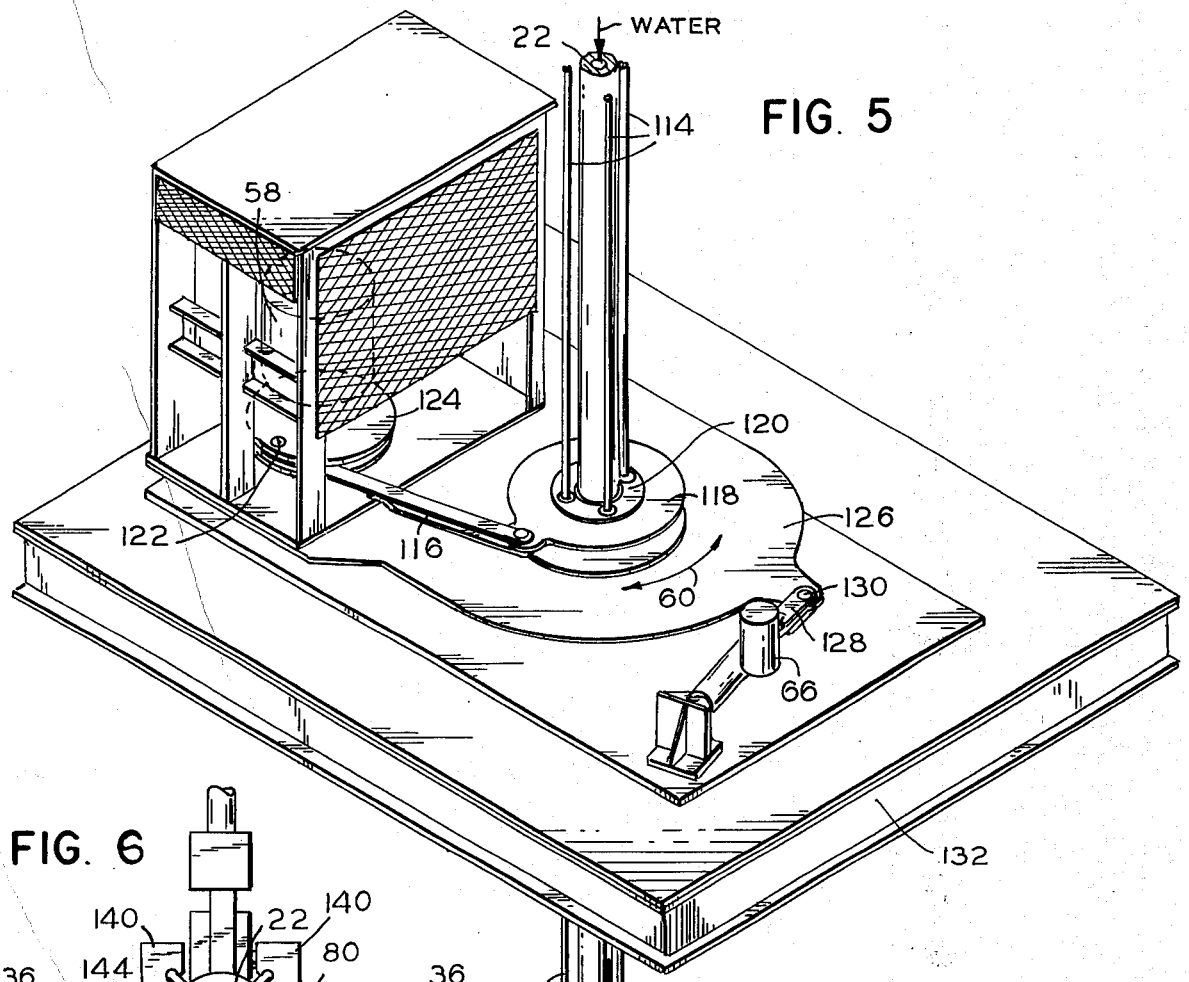
FIG. 5
FIG. 6
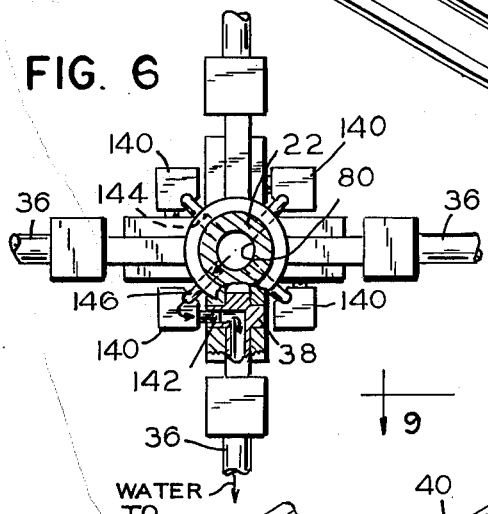
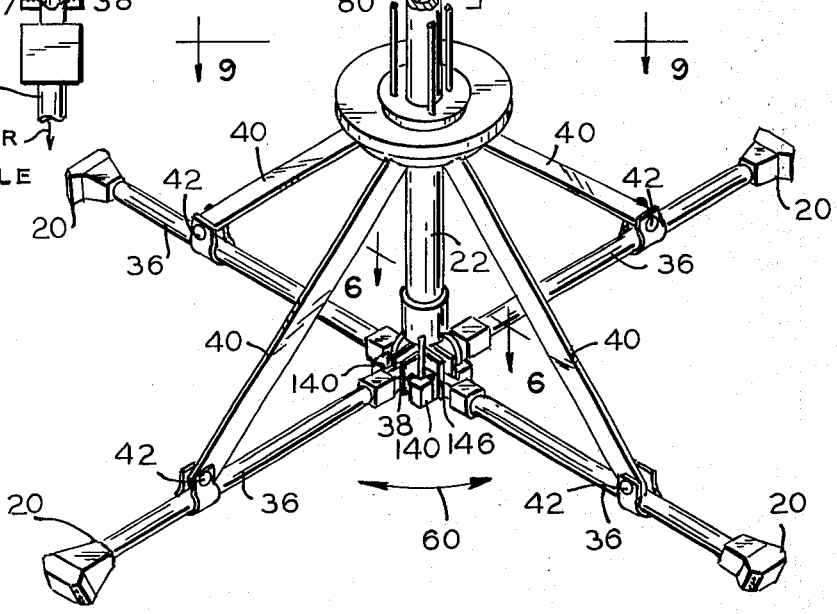

AUTOMATIC SPRAY CLEANING APPARATUS AND METHOD

BACKGROUND OF THE INVENTION

The subject matter of the present invention relates generally to a high pressure liquid spray cleaning apparatus and method, and in particular to such a cleaning apparatus and method in which the liquid spray is directed at an acute angle between its axis and the surface of the object being cleaned, such angle and the spacing between the spray nozzle and such surface being maintained substantially constant over a given surface area. The pressure of the cleaning liquid at the object surface is also maintained substantially constant over the given area in the range of about 2,000 to 6,000 psi. This results in a tangential shearing action which removes any material coated on the object surface quickly and efficiently.

The cleaning apparatus and method of the present invention are especially useful in cleaning the interior surfaces of container tanks, such as those in which chemical reactions are performed including the polymerization of polyvinyl chloride. However, the cleaning apparatus of the present invention is also useful in cleaning external surfaces of flat or rounded objects, such as removing the paint from ships or bridges. When cleaning container tanks, the cleaning apparatus is automatically moved into and out of an opening in the top of such tanks and the cleaning nozzles are moved over the inner surface of the tanks along a complex predetermined path by means of a motor drive means which may be controlled by an electronic computer. This is important because the container tanks are often provided with baffles, agitator blades and other obstructions inside such tanks which must be cleaned in addition to avoiding striking such obstructions with the spray nozzle when the inner surfaces of the tanks are cleaned. Thus, the spray nozzles must move around such internal obstructions along the predetermined path which requires a very complex motion of such nozzles that is accomplished by the computer in accordance with computer programs stored therein.

Previously, most container tanks are cleaned by manual scraping of the interior surface of such tanks which may scratch the surface and requires a man to enter the tanks so that it may be hazardous, especially if such tanks contain dangerous chemicals or fumes. In addition, manual scraping is extremely time consuming and inefficient to that sometimes not all of the material coating the interior surface is removed. This is extremely important in chemical reactor tanks because any material left coated on their interior surface may result in the contamination of succeeding chemical reactions formed in the tank.

For these reasons, it has previously been proposed to clean the interior surface of the container tanks automatically by liquid spray apparatus, such as that shown in U.S. Pat. RE27,612 of Ruppel et al., granted Apr. 3, 1973. However, in this apparatus, the spray nozzles are raised and lowered within the tank by folding support arms which are pivoted by a manually operated winch connected to such support arms through a wire wound on such winch. In addition, the spray nozzles were rotated about two mutually perpendicular axes so the angle formed between the liquid spray and the object surface changed continuously. Thus, the distance between the spray nozzles and the object surface being cleaned varied and the spray angle was not maintained substantially constant over a given surface area. This change in angle and spacing between the liquid spray and the object surface results in slow and inefficient cleaning so that such automatic cleaning apparatus has not been widely adopted.

To a similar effect is the spray cleaning apparatus of U.S. Pat. No. 3,645,452 of Stoeckel et al., granted Feb. 29, 1972, and in U.S. Pat. No. 3,741,808 of Stalker, granted June 26, 1973, both of which vary the distance and angle between the cleaning liquid spray and the surface of the object being cleaned. However, these apparatus employ telescoping support apparatus or cylinder operated support apparatus for moving the nozzles up and down within the container tank, unlike the folding support arms of U.S. Pat. No. RE27,612.

In addition, it has been previously suggested in U.S. Pat. No. 3,358,935 of Andersen, granted Dec. 19, 1967, to provide a liquid spray cleaning apparatus having spray nozzles mounted on folding support arms which are both manually adjusted into different pivot positions for changing the angle and distance between the spray nozzles and the object surface being cleaned. However, there is no means for automatically pivoting the nozzle support arms in order to maintain the nozzles at substantially the same acute angle and spacing distance to the object surface while such nozzles are moved along a predetermined path in the manner of the present invention.

The above mentioned prior spray cleaning apparatus has been subjected to considerable bending forces on the main support shaft which can cause damage to such shaft or at least deflection of the shaft axis so that inefficient cleaning results. This problem is overcome in the apparatus of the present invention by balancing the reactive forces exerted by the liquid sprays on the nozzles and their support arms so that such reactive forces tend to cancel each other or produce substantially no bending force on the main support shaft in all positions of the nozzle support arms. Thus, while in the folded positions of the support arms the reactive forces do not cancel each other, they produce a total resultant force in a direction substantially coaxial to the main vertical support shaft so that it exerts no bending force on such main support shaft.

SUMMARY OF THE INVENTION

It is, therefore, one object of the present invention to provide an improved high pressure liquid spray cleaning apparatus and method of fast and efficient operation.

Another object of the invention is to provide such a spray cleaning apparatus and method in which the axis of the cleaning liquid spray is caused to strike the surface of the object being cleaned at an acute angle which is maintained substantially constant over a given surface area.

Still another object of the invention is to provide such a cleaning apparatus and method in which the spacing between the spray nozzle and the object surface is also maintained substantially constant over such given surface area.

A further object of the invention is to provide such an improved cleaning apparatus and method in which the spray nozzles are moved automatically over the surface of the object along a predetermined path by a drive means controlled by an electronic computer.

An additional object of the invention is to provide such a cleaning apparatus and method in which the pressure of the liquid spray at the object surface is maintained substantially constant over a given surface area.

Still another object of the invention is to provide such a cleaning apparatus and method for cleaning the interiors of container tanks containing internal obstructions.

A still further object of the present invention is to provide such a spray cleaning apparatus and method in which the spray nozzles are attached to folding support arms pivotally mounted on a central shaft and the reactive forces exerted on such nozzles and support arms by the sprays are balanced so that the total resultant bending force applied to the support shaft is minimized in all positions of the folding support arms.

BRIEF DESCRIPTION OF DRAWINGS

Other objects and advantages of the present invention will be apparent from the following detailed description of a preferred embodiment thereof and from the attached drawings of which:

FIG. 3 is an enlarged elevation view of a portion of the apparatus of FIG. 2 taken along the line 3—3 with parts broken away for clarity;

FIG. 4 is a horizontal section view taken along the line 4—4 of FIG. 3;

FIG. 5 is a perspective view of the lower portion of the cleaning apparatus of FIG. 2;

FIG. 6 is a horizontal section view taken along the line 6—6 of FIG. 5;

FIG. 7 is an enlarged horizontal section view taken along the line 7—7 of FIG. 2 showing the position of the spray nozzles relative to the container surface during cleaning thereof;

DESCRIPTION OF PREFERRED EMBODIMENT

Figure 1:
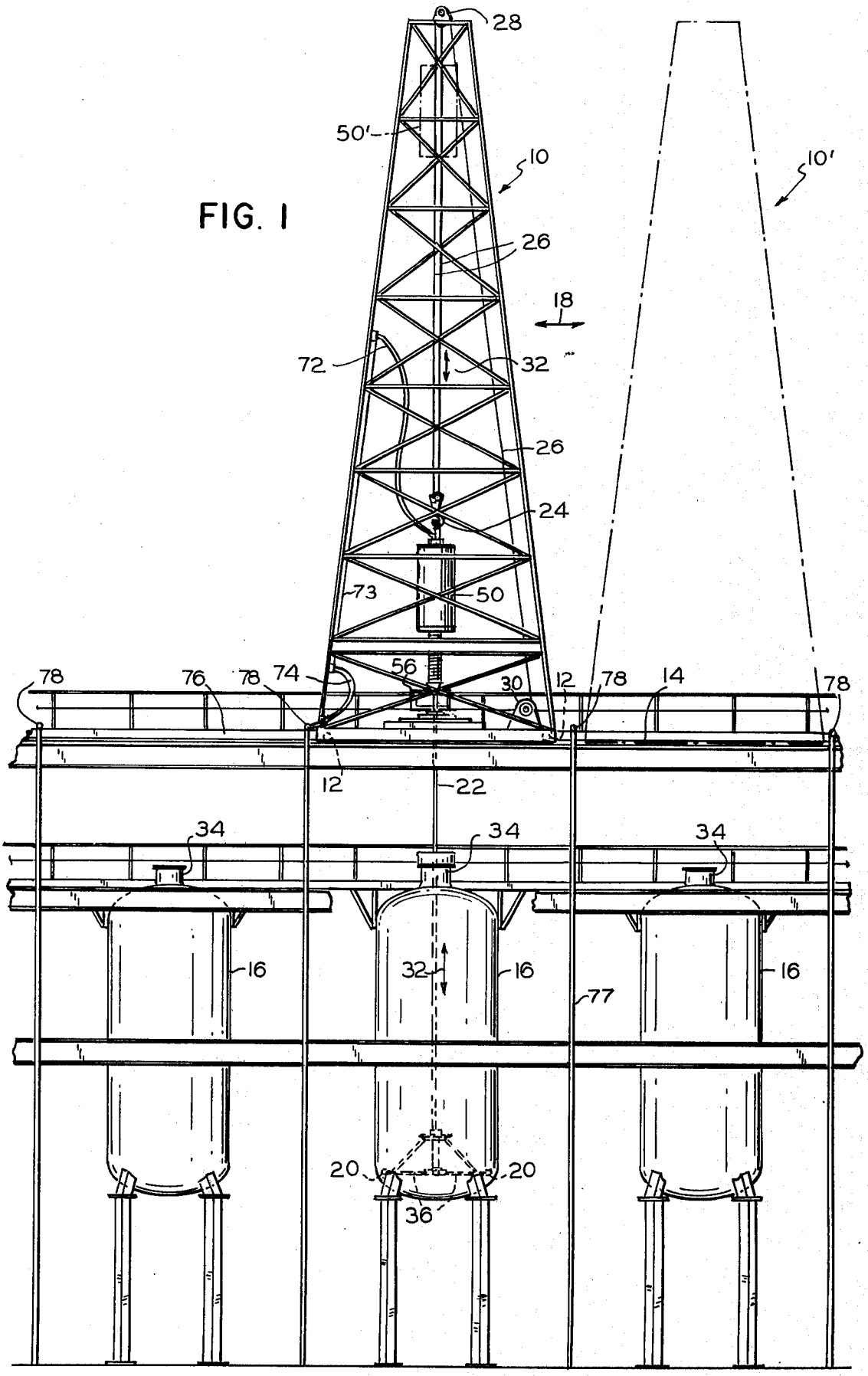
FIG. 1 is a side elevation view of a spray cleaning apparatus in accordance with the present invention supported by a mobile derrick in order to clean a plurality of container tanks.
Figure 2:
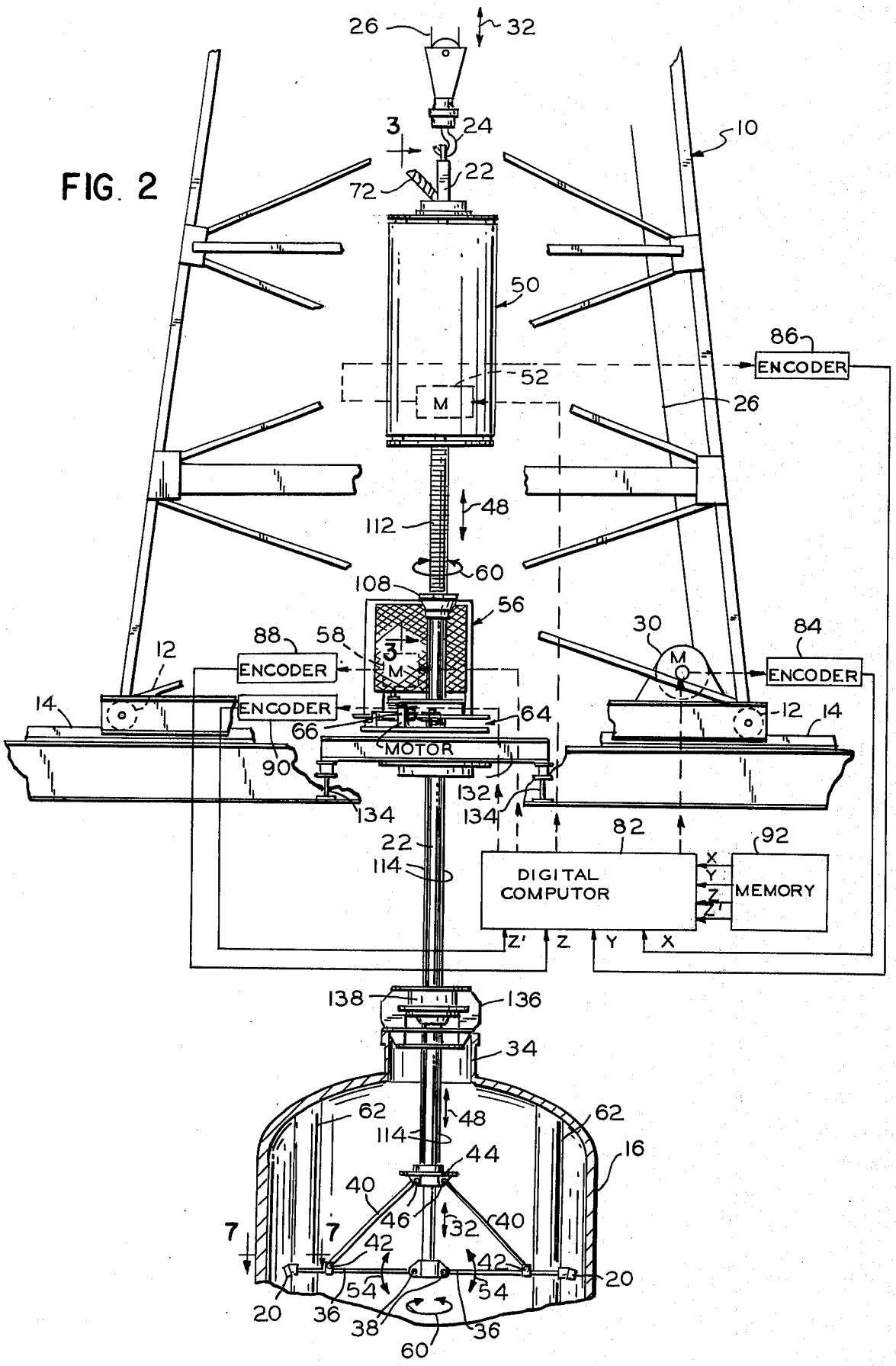
FIG. 2 is an enlarged view of a portion of the cleaning apparatus of FIG. 1 with parts broken away for purposes of clarity, and schematically showing a computer controlled automatic drive means for such cleaning apparatus.

As shown in FIGS. 1 and 2, the spray cleaning apparatus of the present invention includes a mobile derrick 10 for supporting such cleaning apparatus. The derrick is mounted on wheels 12 for movement along a pair of guide rails 14 which extend along a plurality of container tanks 16 which are to be cleaned. Thus, the derrick may be moved longitudinally over the tanks in the direction of arrows 18 between the position shown in solid lines and the position shown in phantom lines labeled 10' in order to clean two different container tanks. This movement of the derrick 10 may be accomplished by a motor driven cable drum and associated cable connected to the derrick in a conventional manner which have not been shown for purposes of simplicity. The cleaning apparatus of the present invention includes four spray nozzles 20 supported on a vertical support shaft 22 whose upper end is attached to a swivel hood 24 supported by a cable 26 which extends around block and tackle pulleys including pulley 28 attached to the upper end of the derrick. The cable 26 is coupled to the drive shaft of a hoist motor 30 mounted at the bottom of such derrick for raising and lowering the cleaning apparatus in the vertical direction of arrows 32. This moves the spray nozzles 20 up and down within the container tanks in the direction of arrows 32, hereafter referred to as the X direction, as well as moving such nozzles in and out of the tanks through an opening 34 at the upper end of each tank after the nozzle support arms are folded inward toward the shaft 22 in a manner hereafter described.

The spray nozzles 20 are fixedly attached to folding support arms 36 which are pivotally secured at pivots 38 to the lower end of the support shaft 22. In addition, the support arms are pivotally attached to support links 40 at pivots 42 midway between the ends of such arms while the other end of the links are pivotally connected to a common actuating head 44 at pivots 46. The actuating head 44 is moved up and down along the support shaft 22 in the direction of arrows 48 by a screw jack type of drive means 50 sold under the name "Jactuator" by Duff-Norton Company, and its associated drive motor 52 in a manner hereafter described with reference to FIGS. 3 and 4. As a result, the nozzle support arms 36 are folded about pivots 38 in the direction of arrows 54 in and out relative to the longitudinal axis of the support shaft 22 to vary the radial distance between the nozzles 20 and the axis of such support shaft in a direction hereafter referred to as the Y direction. It should be noted that the folding movement of the support arms 36 and links 40 in the direction of arrows 54 causes the nozzles 20 to move both horizontally in the Y direction but also vertically in the X direction. However, movement of the nozzles 20 only in the vertical or X direction is achieved solely through raising and lowering the shaft 22 by the hoist motor 30.

Figures 8A, 8B, 8C, 8D, 8E, 8F:
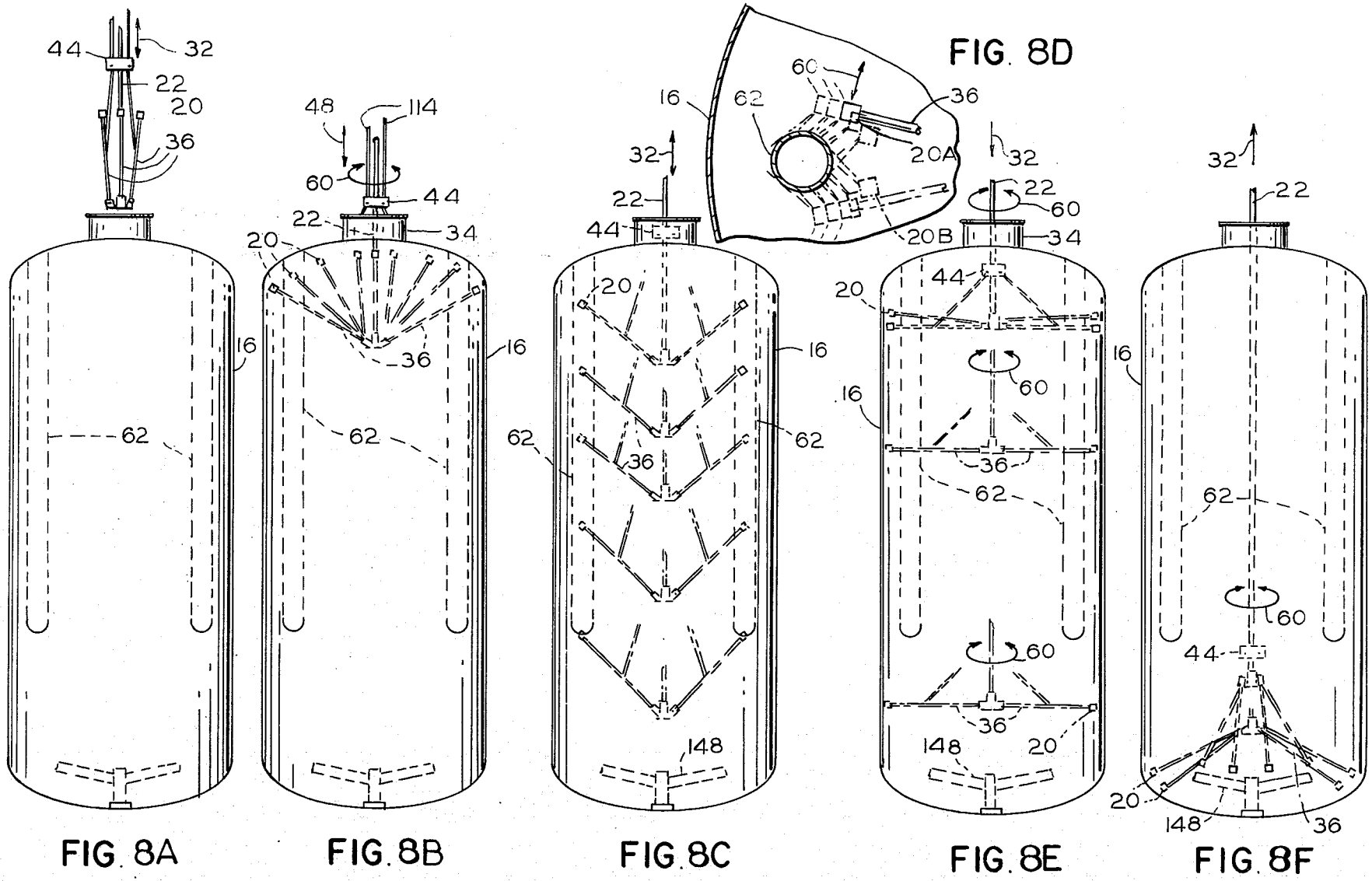
FIGS. 8A, 8B, 8C, 8D, 8E and 8F show various steps in the cleaning method of the present invention when it is used to clean a chemical reactor tank.

The nozzles 20 and the vertical support shaft 22 are rotated about the axis of such shaft in a Z direction shown by arrow 60 through a predetermined arc in an oscillating manner by the third drive means 56 and associated motor 58 in a manner hereafter described with reference to FIG. 5. If the container tank is provided with internal obstructions, such as four heat exchanger baffles 62 used in chemical reactive tanks for polymerizing polyvinyl chloride, four symmetrically spaced nozzles must be rotated through an arc less than 90° of, for example, 69° between the baffles to clean the interior surface of the tank and avoid striking such baffles which extend vertically in the tank. In addition, in order to clean the baffles, a second arcuate drive means 64 is provided including an indexing motor 66 which rotates the nozzles and support arms 36 in the Z direction between a plurality of predetermined radial index positions of, for example, ten in number corresponding to different positions of each nozzle about the periphery of one of the cylindrical baffles 62 for cleaning such baffles, as shown in FIG. 8D. This index drive means is also shown in greater detail in FIG. 5.

As shown in FIGS. 1 and 3, the cleaning liquid sprayed by nozzles 20 is transmitted through the nozzle support arms 36 and the support shaft 22 from a swivel fitting 68 connected to the top of shaft 22 and mounted on the upper end of the housing 70 of the jactuator drive 50. The swivel fitting 68 is necessary because the support shaft 22 is rotated through an arc by the arc drive means 56. A flexible hose coupling 72 connects the swivel fitting to the upper end of a pipe 73 attached to the derrick 10 and whose lower end is connected by a second flexible hose coupling 74 to a header pipe 76. The header 76 extends horizontally along the guide rail 14 above the container tanks 16 and is connected to a high pressure water line by vertical pipes 77 provided with a plurality of outlets 78 adjacent such tanks so that the hose coupling 74 may be disconnected and reconnected to different outlets when the derrick is moved from tank to tank. A cleaning liquid under high pressure on the order of 2,000 to 6,000 psi is supplied to the header pipe 76. This cleaning fluid, which may be water or a chemical cleaning agent, is transmitted through the flexible couplings 72 and 74 into a passageway 80 within the support shaft 22 which conveys such fluid down to the nozzle support arms 36 and on out of the nozzles 20.

As shown in FIG. 2, each of the drive motors 30, 52, 58 and 66 is controlled automatically by an electronic computer 82 which may be of the digital type whose outputs are connected to such motors. The output shafts of these motors 30, 52, 58 and 66 are coupled to shaft encoders 84, 86, 88 and 90, respectively, which convert the rotation of each shaft into a digital electrical signal corresponding to the number of shaft rotations and therefore the position of the nozzles 20 moved by such motors. Thus, the output of encoder 84 connected to the hoist motor 30 indicates the X position of the nozzles 20 in the vertical direction due to movement 32 of the support shaft 22. Similarly the output of the encoder 86 connected to jactuator motor 52 indicates changes in the Y position of the nozzles 20 relative to shaft 22 in the horizontal direction due to the folding movement 54. The output of the encoder 88 connected to motor 58 indicates the Z position of the nozzles 20 in the radial direction about the axis of support shaft 22 during an arc oscillation 60. Similarly the output of encoder 90 coupled to index motors 66 indicates the Z′ position of the nozzles in one of the ten arcuate index positions. These X, Y, Z and Z′ signals are transmitted as inputs to the computer 82 and compared with output reference signals of a memory circuit 92 in such computer corresponding to the desired X, Y, Z and Z′ positions. The computer memory 92 is programmed to cause the computer to automatically control the drive motors 30, 52, 58 and 66 to scan the nozzles 20 over the entire surface of the object being cleaned in a predetermined path by moving the nozzles rotationally about the cleaning axis of shaft 22 and longitudinally along such axis while maintaining the angle A between the axis of the spray and such surface, as well as the distance X between the nozzles and the object surface substantially constant at a given longitudinal position on the cleaning axis, as shown in FIG. 7. Thus, for example, the computer 82 actuates the hoist motor 30 to move the cleaning apparatus vertically in the X direction of arrows 32 until it reaches the predetermined X position which is indicated when the output signal of the encoder 84 equals the X reference signal stored in memory 92. At this point the computer stops the hoist motor 30 so that the nozzles will be allowed to clean the surface portion of the tank 16 in that vertical position. Of course it should be understood that the X, Y, and Z reference signals will change in accordance with the computer program stored in the memory. In this manner, the computer nozzles 20 are caused to be moved automatically along a predetermined path to clean the entire surface of the container and to clean any obstructions within the container tank, such as baffles 62, as well as moving around such obstructions, as shown in FIGS. 8A to 8F hereafter described.

As shown in FIG. 7, when the spray nozzles 20 are rotated about the cleaners axis of shaft 22 across the inner surface of the contaner tank 16, the angle A between such inner surface and the longitudinal axis 150 of each of the two sprays emitted from the nozzle is maintained substantially constant over a given surface area of a given longitudinal position on such cleaning axis. Angle A is an acute angle preferably approximately 45° but can be any selected angle within a range of about 30° to 60° without greatly reducing the cleaning efficiency. In addition, the distance X along axis 150 between the spray outlet opening of the nozzle 20 and the surface being cleaned is also maintained substantially constant over such given surface area. The perpendicular spacing of the nozzle from the surface is preferably about six inches, although it can be greater or less than that amount depending upon the pressure of the cleaning liquid which is typically about 4,000 psi. As a result of maintaining the spacing distance X substantially constant, the pressure of the cleaning liquid at impact on the object surface being cleaned is also maintained substantially constant. The constant angle A, constant distance X and constant pressure of the spray cause a tangential shearing action which cuts through the surface of the material coated on the object surface and strips away such coating by pealing it back from the object surface. This is a more efficient cleaning method than is achieved by the prior cleaning method which cause the spray angle and spacing to vary in a random manner which prevents such tangential shearing and pealing. It should be noted that while the angle A between the spray axis and the object surface, and the distance X between the spray nozzle and such object surface may vary somewhat at different positions within the tank, they are maintained substantially constant for a given surface area at a given longitudinal position on the position on the cleaning axis in order to provide the tangential shearing action and peeling which is necessary for removal of foreign material coated on the inner surface of the container.

The jactuator drive means 50 connected to motor 52 for pivoting the nozzle support arms 36 in the direction 54 to fold such arm in and out relative to the axis of shaft 22, is shown in FIGS. 3 and 4. The output shaft of the motor 52 is coupled to a gear shaft 94 by a belt 96 after passing through a suitable gear reducer. This gear shaft 94 is coupled to a second gear shaft 98 through a coupling shaft 100 and two 90° gear boxes 102. The gear shafts 94 and 98 are provided with worm gears 101 and 103, respectively, which drive both of a pair of screw shafts 104 and 106 provided on opposite sides of the support shaft 22 to cause such shafts to move up and down in the vertical direction of arrows 48. The lower ends of the screw shafts 104 and 106 are attached to an upper head 108 by pins 109 for movement of the head with such shafts. A pair of protective tubes 110 cover the upper ends of the screw shafts 104 and 106 within the jactuator housing 70, while a pair of flexible bellows 112 are provided around the lower ends of such screw shafts outside of such housing. The lower ends of the bellows are attached to lower ends of the screw shafts for movement therewith. The upper coupling head 108 is coupled to the lower actuating head 44 of FIG. 2 by four connecting rods 116 which extend along the support shaft 22. As a result the lower head 44 is moved up and down in the direction of arrows 48 and this movement is coupled by links 40 to the nozzle support arms 36 to pivot such support arms about pivots 38 in the direction of arrows 54, and thereby fold the arms in and out relative to the axis of the support shaft 22.

As shown in FIG. 4, the encoder 86 may be coupled to the gear shaft 98 which rotates at a speed related to the rotation of the output shaft of a motor 52. The other encoders may also be indirectly coupled to their respective motors. For example encoder 84 may actually be operated by up and down movement of the jactuator housing which of course is controlled by the movement of cable 26 with the hoist motor 30. Thus, the movement of the encoder 84 by coupling it to the jactuator housing 70 is also related to the rotation of the shaft of motor 30.

As shown in FIG. 5, the rotation of the nozzles 30 about the axis of the support shaft 22 through a predetermined arc in the direction of arrows 60 is accomplished by motor 58 shose output shaft is coupled through a link 116 to a drive platform 118. The drive platform is keyed to the vertical support shaft 22 and to the connecting rods 114 for rotation of such shaft and rods. It should be noted that the shafts 22 and coupling rods 114 also move longitudinally with respect to the drive platform 118 so that they slide in nylon bearing sleeves supported by a bearing member 120 in the center of such platform. The link 116 is attached by a pivot 122 to the periphery of a drive wheel 124 which is rotated by motor 58 to oscillate the drive platform 118 through a predetermined arc of, for example, 69° corresponding to the distance between the four baffles 62.

A second drive platform 126 is provided for rotating the support shaft 22 and the coupling rods 114 into a predetermined number of index positions of, for example, ten positions within an additional arc of about 21° by means of the index motor 66 to clean the baffles 62. The motor 66 has a worm gear type coupling for driving a link 128 longitudinally which is coupled by a pivot 130 to the second drive platform to rotate such drive platform between the predetermined index positions. It should be noted that the arc drive motor 58 and its associated coupling 116, 122 and 124 are mounted on the second drive platform 126 so they are also moved with such platform into the index positions. These ten index positions are spaced around the periphery of the baffles 62, as shown in FIG. 8D, to enable the cleaning of such baffles. After the first drive platform 118 rotates the nozzles to the end of the 69 degree arc, the drive disc 134 is locked automatically against return movement during cleaning of the baffles and the index motor 66 rotates the second drive platform 126 into the several predetermined index positions within the 21 degree arc. Thus, the index position angle is added to the 69 degree arc in order to properly position the nozzles. In each one of these index positions, the support shaft 22 and nozzles 20 are moved up and down by the hoist motor to clean the entire length of each baffle, as shown in FIG. 8C.

Both of the drive platforms and their associated motors are supported on a common support base 132, which is releasably mounted on support rails 134 provided above each of the reactor tanks 16, as shown in FIG. 2. However, the vertical support shaft 22 and the connecting rods are accurately aligned with the center of the tank 16 by a lid bearing cap 136 which fits over the tank opening 34 to seal such opening while enabling rotation of the shaft 22 and connecting rods 114 in a bearing member 138 within such cap. The bearing member 138 also includes nylon bearing sleeves to enable longitudinal movement of the connecting rods and shaft 22 relative to such bearing member.

As shown in FIG. 6, the water or other cleaning liquid flowing through the passageway 80 in the support shaft 22 is transmitted out of such shaft through a high pressure swivel joint 40 and into the hollow support arms 36 before being sprayed out of the nozzles. Thus, one of the pivot projections 38 on each of the arms is provided with a passageway 142 which communicates with the interior of one of the swivels 140 and with the support arm passage. It should be noted that the bottom end of the shaft 22 is closed except for four radially extending passageways 144 which extend at right angles to the axis of passage 80 and are connected to the swivel joints 140 by connecting tubes 146, as shown in FIG. 5. The swivel joints 140 are each connected by a swivel connection to the passage 142 to enable the support arms 36 to pivot while maintaining a liquid tight seal.

The operation of the cleaning apparatus of the present invention is shown in FIGS. 8A to 8F. First the nozzle supports arms 36 are folded upward into a position substantially parallel to the main support shaft 22 by upward movement of the actuator head 44, to enable the cleaning apparatus to be raised and lowered through the opening 34 in the top of the tank 16, as shown in FIG. 8A. This lowering of the cleaning apparatus in the tank is accomplished by vertical movement of the shaft 22 in the direction of arrows 32 by the hoist motor 30. Once the apparatus is inside the container tank 16 the nozzle support arms 36 are partially unfolded outward until they are in position adjacent the inner surface of the top of the tank as shown in FIG. 8B. This unfolding of the support arms 36 is accomplished by downward movement of the coupling rods 114 and the lower head 44 in the direction of arrows 48 by motor 52. Then, cleaning liquid is caused to flow through the nozzles 20 to produce sprays which strike the interior surface of the top of the container tank. In each radial position the nozzles and their support arms, as well as the support shaft 22, are rotated back and forth through an arc of 69° in the direction of arrows 60 for cleaning an annular band portion of such top surface by motor 58. It should be noted that the sprays of adjacent nozzles overlap at the opposite ends of the 69° arc, as shown in FIG. 7 by the intersection of the center lines 150 of such sprays, so that the entire surface of the tank is cleaned. The support arms 36 are unfolded further so that the nozzles are positioned farther away from the support shaft 26 and the oscillating rotation is continued until the entire top surface is cleaned.

In order to clean the four longitudinal baffles 62, arcuate oscillation of the cleaning apparatus is stopped by locking the output drive wheel 124 of motor 58 in the farthest position at the end of the 69 degree arc.

Then the indexing motor 66 is operated to further rotate the nozzle arms into one of ten predetermined positions about the periphery of the baffle cylinders, including five positions 20A on one side and five positions 20B on the other side of the baffle, as shown in FIG. 8D. These ten positions are spaced over an arc of 21° around the outer surface of the baffle 62 in order to enable the entire surface of the baffle to be cleaned. In each one of these predetermined index positions, the nozzles 20 are moved longitudinally along the entire length of the baffles in the direction of arrows 32 by the hoist motor 30, as shown in FIG. 8C. In this manner all four of the baffles are cleaned, each by a different one of such nozzles.

Once the baffles are cleaned, the nozzle arm are folded further outward into their fully extended position to locate the nozzles 20 closely adjacent to the inner surface of the sides of the tank, as shown in FIG. 8E. This is achieved by moving the coupling rods 114 and the head 44 downward relative to the support shaft 22 in the direction 48. Then the side surface of the tank is cleaned by rotating the support shaft 22 and the nozzles 20 through the arc of 69° in the direction of arrow 60. At the same time, the support shaft 22 is moved downward in the direction of arrow 32 the entire length of the tank, except for the bottom end portion immediately adjacent agitator blades 148. As discussed previously, the entire side surface of the tank is cleaned, not only the side surface portion between the baffles 62 but also the side surface portion behind the baffles because of the overlapping of the sprays of adjacent nozzles at the opposite ends of the 69° arc, as shown in FIG. 7. Of course this overlapping also enables cleaning the entire side surface of the tank in that portion of the tank below the bottom end of the baffles as well.

As shown in FIG, 8F, the bottom of the container tank 16 and the agitator blades 148 mounted thereon are cleaned by folding the nozzle arms downward and inwardly toward the support shaft 22 by further downward movement of the connecting rods 114 and head 44 in the direction of arrow 48, while at the same time rotating the support shaft 22 in the direction of arrow 60 and moving such shaft upward in the direction of arrow 32. This upward movement is necessary to enable the nozzles to clear the agitator blades 48 when they are swung inwardly to clean the bottom most portion of the tank immediately below such blades. It will be noted that the angle and spacing of the water spray and nozzle with respect to the inner surface of the bottom portion of the tank varies in the region underneath the agitator blades 48. However, on other surface areas of the tank, including the sides, the angle and spacing between the spray axis and the surface being cleaned remains substantially constant over a given surface area. This is true for repeated cleaning cycles, if they are necessary, because of the fact that the nozzles are moved in the same predetermined path over the interior surface of the container for each cycle by the computer which controls the drive motors as previously discussed with respect to FIG. 2.

Figure 9:
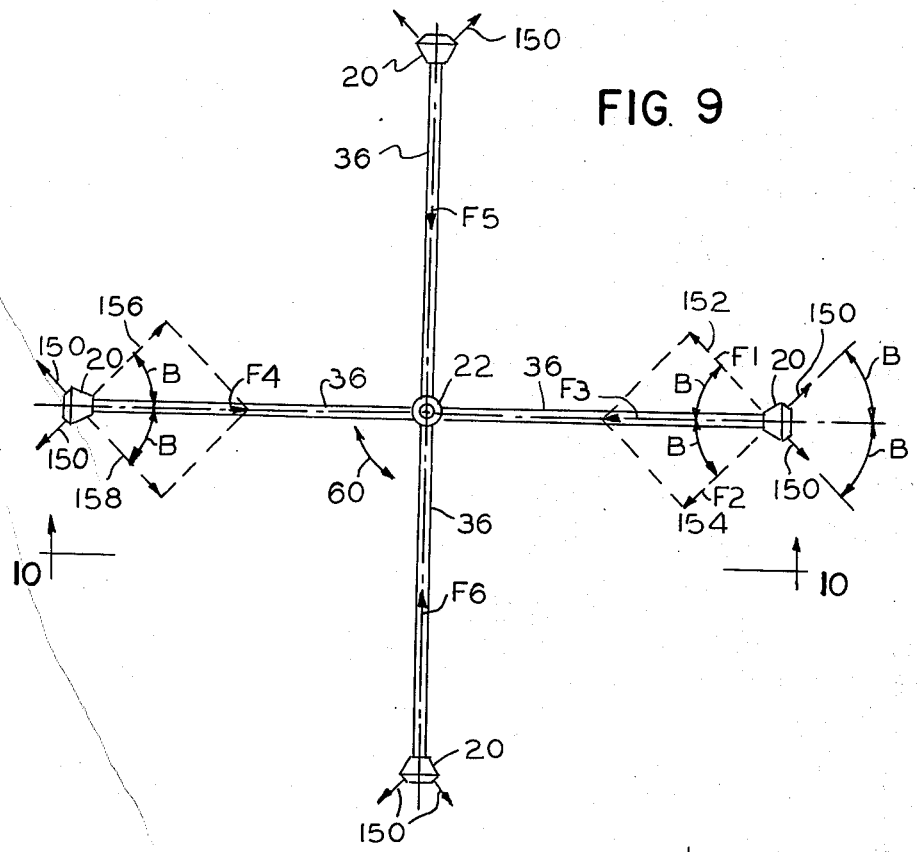
FIG. 9 is a schematic diagram and partial horizontal section view along the line 9—9 of FIG. 5 showing the reactive forces exerted on the spray nozzles and their support arms by the water spray emitted from such nozzles.
Figure 10:
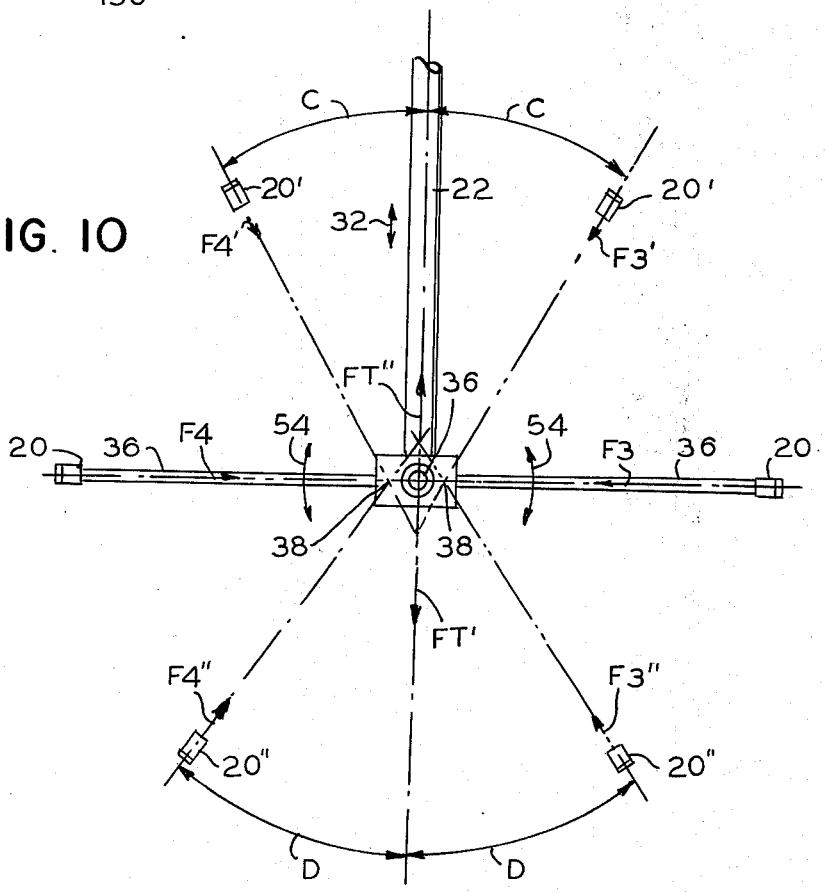
FIG. 10 is a horizontal view taken along the line 10—10 of FIG. 9 schematically showing such reactive forces and the total resultant force produced thereby in different positions of the nozzle support arms.

The two water sprays emitted from each of the nozzles apply reactive forces to such nozzles which tend to bend the nozzle support arms 36 and also tend to bend the vertical support shaft 22 since such shaft is mounted by bearings 138 and 120 to prevent horizontal pivoting movement of the shaft. In order to overcome this problem, the cleaning apparatus of the present invention is designed so that these reactive forces are balanced and do not exert any such bending force. Thus, as shown in FIGS. 9 and 10, each of the nozzles 20 emits two liquid sprays having longitudinal axes 150 which exert two reactive forces $F_1$ and $F_2$, respectively, on the nozzle. These reactive forces, labeled 152 and 154 for one nozzle, are balanced so that when added they form a total reactive force $F_3$ which extends inwardly along the axis of the support arm 36. Balanced reactive forces 152 and 154 are substantially equal and their force vectors extend at the same angle B to the axis of the nozzle support arm 36.

In a similar manner, the reactive forces 156 and 158 produced on the other nozzle 20 in alignment with the first mentioned nozzle, are balanced to produce a total reactive force $F_4$ which is also in alignment with the axis of its support arm 36. The total reactive forces $F_3$ and $F_4$ are made to be equal so that they cancel each other when the arms 36 extend in opposite directions in the middle position of FIG. 10. However, even when the support arms are raised or lowered by folding them in the direction of arrows 54, the total forces $F_T'$ and $F_T''$, respectively, equal to the sum of reactive forces $F_3'$ and $F_4'$ in the upper position and to the sum of reactive forces $F_3''$ and $F_4''$ in the lower position, do not cause any bending of the vertical support shaft 20. This is because these total forces $F_T'$ and $F_T''$ always extend coaxial with the longitudinal axis of the support arm 20. This is due to the fact that the reactive forces $F_3$ and $F_4$ are equal and the angle C or D between the support arms and the axis of the vertical support shaft 20 is always the same for both arms, as shown in FIG. 10. Of course, the other two nozzles are balanced in a similar manner if the total reactive forces $F_5$ and $F_6$ of such nozzles are made substantially equal and extend coaxial with the axis of their support arms. In addition, it should be noted that by making the two reactive forces 152 and 154 on each nozzle substantially equal in magnitude and extending at substantially the same angle B to the axis of the support arm, the water sprays do not tend to rotate the support shaft 22.

It will be obvious to those having ordinary skill in the art that many changes may be made in the details of the above-described preferred embodiment of the present invention without departing from the spirit of the invention. Thus, while reactive forces $F_3$ $F_4$ must be equal and reactive forces $F_5$ and $F_6$ must be equal, they need not all be the same. However, this would be necessary if an odd number of support arms were employed in order to balance the forces and prevent bending of the shaft 22. Therefore, the scope of the present invention should only be determined by the following claims.

We claim:

1. Automatic cleaning apparatus for removing material coated on the inner surfaces of containers by spraying cleaning liquid at said surfaces in which the improvement comprises:

sprayer means for spraying said cleaning liquid under high pressure at the inner surfaces of said containers and including stream forming means for forming at least one stream of said liquid having a longitudinal axis;

automatic drive means for moving said stream forming means over the container surfaces along a predetermined path to scan said container surfaces with said liquid stream, said drive means moving said stream forming means about a cleaning axis and longitudinally along said cleaning axis during the scanning; and support means coupled to said drive means for supporting said sprayer means during said scanning, including first support means for causing the liquid stream to strike container surfaces at an acute angle between said stream axis and the surface impinged thereby and for automatically maintaining said acute angle substantially constant over given surface areas of said container surfaces during scanning as said stream forming means moves about said cleaning axis at a given longitudinal position on said cleaning axis, and second support means for automatically maintaining the spacing distance along the stream axis between said stream forming means and the container surfaces substantially constant during said scanning at said given longitudinal position.

2. Cleaning apparatus in accordance with claim 1 which includes means for maintaining the pressure of said liquid stream substantially constant at said container surface over said given surface area.

3. Cleaning apparatus in accordance with claim 1 in which the containers are tanks whose inner surfaces are cleaned by the liquid stream and the drive means is a programmed drive means which includes first drive means for moving the stream forming means into and out of said tanks along the cleaning axis.

4. Cleaning apparatus in accordance with claim 3 in which the tanks are cylindrical and the cleaning axis corresponds to the axis of the cylindrical tank.

5. Cleaning apparatus in accordance with claim 3 in which the tanks contain internal obstacles and the drive means automatically moves said stream forming means between and around said obstacles.

6. Cleaning apparatus in accordance with claim 3 in which the drive means includes second drive means for moving the stream forming means radially toward and away from said cleaning axis inside said tanks.

7. Cleaning apparatus in accordance with claim 6 in which the drive means includes third drive means for pivoting the stream forming means about said cleaning axis during cleaning.

8. Cleaning apparatus in accordance with claim 1 in which the drive means includes an electronic computer which is programmed to cause said stream forming means to move along said predetermined path.

9. Cleaning apparatus in accordance with claim 7 in which the stream forming means includes a plurality of nozzles which form a plurality of said liquid streams.

10. Cleaning apparatus in accordance with claim 8 in which the nozzles are moved automatically around internal obstructions within the container tanks.

11. Cleaning apparatus in accordance with claim 10 in which the tanks have internal longitudinal baffles and the second and third drive means radially move and pivot each of the nozzles into a plurality of different lateral positions adjacent a different one of said baffles and the first drive means moves the nozzles longitudinally along said baffles in said lateral positions.

12. Cleaning apparatus in accordance with claim 11 in which the nozzles are oscillated across the inner surface of the tank between said baffles by said third drive means.

13. Cleaning apparatus in accordance with claim 6 in which the second drive means is positioned outside the tank and is coupled to a plurality of folding support arms which support stream forming nozzles within said tank for folding and unfolding said support arms to radially move said nozzles toward and away from the cleaning axis.

14. Cleaning apparatus in accordance with claim 6 in which the support arms are pivotally mounted on a central support shaft which is raised and lowered by the first drive means and which is provided with a passage means for transmitting the cleaning fluid through the support shaft and the support arms to said nozzles.

15. Cleaning apparatus in accordance with claim 3 which also includes means for moving the cleaning apparatus from one tank to another.

16. A cleaning method for removing material coated on the surfaces of a container comprising the steps of:

forming a stream of cleaning liquid;

directing the liquid stream at said surfaces so that the longitudinal axis of said stream forms an acute angle with said surface; and scanning said stream over said surface by moving said stream about a cleaning axis and longitudinally along such axis with a support means while maintaining said angle substantially constant over a given surface area during scanning at a given longitudinal position on said cleaning axis and while maintaining the spacing distance along the stream axis between the source of said liquid stream and the container surface substantially constant during said scanning at said given longitudinal position, without contacting said surface with said support means.

17. A method in accordance with claim 16 which also includes maintaining the pressure of said stream at said surface substantially constant during movement of the stream over said given surface area.

18. A method in accordance with claim 16 in which the container is a tank and the liquid stream is directed at the inner surface of said tank.

19. A method in accordance with claim 16 in which the stream is moved over the surface of the object automatically along a predetermined path by a programmed drive means.

20. A method in accordance with claim 18 in which the stream is moved accurately along said predetermined path by an electronic computer.

21. A method in accordance with claim 18 in which the source of the liquid stream is moved longitudinally into and out of said tank along the cleaning axis, is moved radially toward and away from said cleaning axis, and is pivoted about said cleaning axis.

22. A method in accordance with claim 21 in which the source is so moved automatically along a predetermined path over the inner surface of said tank by an electronic computer in an accurate manner.

23. A method in accordance with claim 22 in which the three types of movement are accomplished by three different motors controlled by said computer.

24. A method in accordance with claim 16 in which a plurality of streams of liquid are simultaneously directed at the surface of the object in different directions but at substantially the same angle.

25. A method in accordance with claim 24 in which the sources of said plurality of streams are all spaced substantially the same distance from said object surface.

26. Cleaning apparatus for cleaning the surfaces of container tanks by spraying cleaning liquid at said surfaces, in which the improvement comprises:

sprayer means for spraying said cleaning liquid under high pressure through a plurality of nozzles which each emit at least two streams of said liquid;

support means for supporting said nozzles on support arms extending radially outward from a common support shaft which is supported to prevent nonaxial pivoting movement of said shaft so that the nozzles of each pair are space symmetrically about the axis of said common shaft; and means for balancing the reactive forces applied to said common shaft and to said inserted support arms by the liquid streams emitted from said nozzles so that substantially no total bending force is exerted on said common shaft or said support arms.

27. Cleaning apparatus in accordance with claim 26 in which the axes of the two streams emitted from each nozzle form acute angles to the axis of its support arm which are substantially equal angles on opposite sides of the support arm axis.

28. Cleaning apparatus in accordance with claim 27 in which the two streams emitted from each nozzle are balanced so that together they produce a total reactive force in a direction substantially coaxial with the support arm of said nozzle.

29. Cleaning apparatus in accordance with claim 26 in which the nozzles are supported in pairs with the two nozzles of each pair spaced apart by 180° and the total reactive forces produced on said two nozzles by the streams emitted therefrom are substantially equal and are directed at the common shaft in substantially opposite directions.

30. Cleaning apparatus in accordance with claim 29 in which the support means includes means for folding the support arms in and out relative to the axis of the common shaft equally so that each of said arms extends at substantially the same angle to the common shaft, and when said arms form an acute angle to the axis of said common shaft the total reactive forces produced on the two nozzles of each pair combine to produce a resultant force in a direction substantially coaxial with said common shaft.

31. Cleaning apparatus in accordance with claim 26 in which the common shaft and the support arms are provided with axial passage for transmitting the cleaning liquid therethrough to said nozzles.

32. Cleaning apparatus in accordance with claim 26 which includes drive means for rotating said common shaft about the axis of said shaft.

33. Cleaning apparatus in accordance with claim 32 in which the drive means rotates the common shaft in an oscillating manner and pivots the support arms in and out relative to the axis of said common shaft.

34. Automatic cleaning apparatus for removing material coated on the inner surfaces of containers by spraying cleaning liquid at said surfaces in which the improvement comprises:

sprayer means for spraying said cleaning liquid under high pressure at cylindrical inner surfaces of said containers and including stream forming means for forming at least one stream of said liquid having a longitudinal axis;

automatic drive means for moving said stream forming means over the container surfaces along a predetermined path to scan said container surfaces with said liquid stream, said drive means moving said stream forming means rotationally about a cleaning axis and longitudinally along said cleaning axis during the scanning;

support means coupled to said drive means for supporting said sprayer means during said scanning, including first support means for causing the liquid stream to strike cylindrical container surfaces at an acute angle between said stream axis and the surface impinged thereby and for automatically maintaining said acute angle substantially constant over given surface areas of said cylindrical container surfaces during scanning as said stream forming means rotates about the cleaning axis at a given longitudinal position on said axis, and second support means for automatically maintaining the spacing distance along the stream axis between said stream forming means and the container surfaces substantially constant during said scanning at said given longitudinal position; and means for maintaining the pressure of said liquid stream substantially constant at said cylindrical container surfaces.

* * * * *

UNITED STATES PATENT AND TRADEMARK OFFICE

CERTIFICATE OF CORRECTION

PATENT NO. : 3,985,572

DATED : October 12, 1976

INVENTOR(S) : James P. Petermann et al.

It is certified that error appears in the above-identified patent and that said Letters Patent are hereby corrected as shown below:

Column 1, line 50, "to" should be --so--.

Column 6, line 48, delete "on the position" between "position" and "on".

Column 7, line 29, "shose" should be --whose--.

Column 7, line 33, "shafts" should be --shaft--.

Column 9, line 15, "arm" should be --arms--.

Column 13, line 11, Claim 26, delete "inserted" between "said" and "support".

Column 14, line 1, Claim 31, "passage" should be --passages--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*